US005930912A

United States Patent [19]

Carder

[11] Patent Number: 5,930,912

[45] Date of Patent: Aug. 3, 1999

[54] PORTABLE AND COLLAPSIBLE BODY DRYER

[76] Inventor: Kathy Carder, 2675 Windmill Pkwy., #212, Henderson, Nev. 89014

[21] Appl. No.: 09/033,425

[22] Filed: Mar. 2, 1998

[51] Int. Cl.[6] ..... F26B 19/00

[52] U.S. Cl. ..... 34/90; 34/202

[58] Field of Search ..... 34/90, 103, 104, 34/106, 107, 192, 201, 202; 392/364, 380; 4/526, 600; 607/83, 112

[56] References Cited

U.S. PATENT DOCUMENTS

| | | | |
|---|---|---|---|
| 2,326,981 | 8/1943 | Stenberg | 34/90 |
| 2,832,157 | 4/1958 | Hudson | 34/90 |
| 4,871,900 | 10/1989 | Hickman . | |
| 4,961,272 | 10/1990 | Lee . | |
| 5,003,705 | 4/1991 | Lee . | |
| 5,007,182 | 4/1991 | Fishman et al. . | |
| 5,025,572 | 6/1991 | Cordier . | |
| 5,033,489 | 7/1991 | Ferre et al. | 134/57 R |
| 5,099,587 | 3/1992 | Jarosch . | |
| 5,704,135 | 1/1998 | Riahi | 34/546 |

*Primary Examiner*—Henry Bennett
*Assistant Examiner*—Steve Gravini
*Attorney, Agent, or Firm*—Kenneth L. Tolar

[57] ABSTRACT

The present invention relates to a collapsible, portable body dryer including a substantially rectangular base component having a planar upper surface and four peripheral side edges depending therefrom. Attached to each of two opposing side edges are a pair of lockable casters allowing the device to roll on a support surface. Attached to a third side edge is an elongated arm having a handle at a distal end thereof which may be grasped and pulled by a user. Perpendicularly extending from the upper surface of the base portion are a plurality of telescoping support legs each having a terminal end. Attached to the terminal end of each support leg is a substantially rectangular top portion having an upper surface, a lower surface and four peripheral side edges forming an interior chamber therebetween. Received within the top component interior chamber is an electrical fan and heating element for delivering hot air therebelow. On the lower surface of the top component are a plurality of omni-directional air nozzles for delivering hot air at adjustable angles relative to a user. The collapsible device may be interchangeably used to dry people or pets and may be easily transported between various locations.

10 Claims, 3 Drawing Sheets

PORTABLE AND COLLAPSIBLE BODY DRYER

BACKGROUND OF THE INVENTION

The present invention relates to a body dryer, and more specifically, a body dryer which may be easily collapsed and transported from one location to another.

DESCRIPTION OF THE PRIOR ART

When exiting a bath, shower or swimming pool, a wet bather will be cold until such time as he or she can completely dry off with a towel. Swimmers who exit a swimming pool and immediately enter an air conditioned building often experience an immediate chill. Invalids, the elderly and other similarly incapacitated people usually cannot even dry themselves with a towel unless assisted by another person. Furthermore, a towel can severely irritate the skin of a bum victim or those having similar skin abrasions. Finally, pet owners often bathe their pets at home which requires numerous towels to dry the pet thereafter. Accordingly, there is currently a need for a dryer that can be interchangeably used to dry a pet or a person after bathing or swimming and that eliminates the burdensome practice of using towels.

Although various body dryers exist in the prior art, most relate to a device that is permanently affixed to a bathing area such as a shower stall and therefore cannot be transported to another location such as a swimming pool area. Furthermore, the drying area of these devices which surrounds the user cannot be selectively adjusted to accommodate small children or pets. For example, U.S. Pat. No. 4,871,900 issued to Hickman discloses a hot air dryer suspendible from a ceiling having a flexible skirt that may be selectively lowered to surround a user.

U.S. Pat. No. 5,009,587 issued to Jarosch relates to a bathroom dryer assembly designed to be installed behind the walls and ceiling of an existing bathing area. The assembly includes a blower means, a duct means and a heating means.

U.S. Pat. No. 5,003,705 issued to Lee relates to a drying system which includes an air compressor, a compressed air storage tank, a pressure reducing device, a manifold, a heat device, two delivery devices, an electromagnetic control device and a plurality of drying devices. The device is designed to alternatively deliver hot and cool air.

U.S. Pat. No. 4,961,272 issued to Lee relates to a drying apparatus including a vertical housing having a generally horizontal base portion, a generally vertical intermediate portion and a generally horizontal top portion defining a drying space therebetween. Each portion has a fan and a heating element therein. Each of the heating elements and fans are selectively controlled with a switch means.

U.S. Pat. No. 5,007,182 issued to Fishman relates to a portable body drier comprising a step-on platform having a drying fan therein. The platform has a plurality of apertures therethrough and an upwardly extending surface for spreading a user's toes. A fan is disposed below the platform to force air through the apertures.

U.S. Pat. No. 5,025,572 issued to Cordier discloses a pet dryer including a platform having fixed forward and adjustable rear legs to permit tilting of the platform for drainage.

Although several body drying devices exist in the prior art, none of these devices relate to a body dryer that is both collapsible and portable allowing it to be used indoors for drying a bather or outdoors for drying a pet, a child or a swimmer. Furthermore, the height of the drying area may be selectively adjusted to accommodate users of various sizes.

SUMMARY OF THE INVENTION

The present invention relates to a body dryer comprising a substantially rectangular base component having a planar upper surface with four peripheral sides perpendicularly depending therefrom. Attached to each of two opposing sides of the base portion are a pair of locking casters allowing the base portion to roll on a support surface. Attached to a third side is an elongated arm having a handle member attached to an end thereof allowing a user to easily pull the device from one location to another. Perpendicularly extending from the upper surface of the base component are a plurality of telescoping legs each having a terminal end. Attached to the terminal end of each telescoping leg is a substantially rectangular hollow top component having a planar upper surface, a planar lower surface and four peripheral sides therebetween. Received within the top component is a hot air blower assembly including an electrical fan and a heating element each of which are selectively actuated with a switch disposed on a side of the top component. On the lower surface of the top component are a plurality of omni-directional air nozzles for directing heated air from the blower assembly at selectively adjustable angles with respect to a user. Accordingly, the top component may be collapsed toward the base component to adjust the drying space formed between the base and top components for selectively drying adults, children or pets. The device may also be easily transported from one location to another by grasping the handle and rolling the device. It is therefore an object of the present invention to provide a body dryer that is selectively collapsible.

It is yet another object of the present invention to provide a body dryer that is portable.

It is yet another object of the present invention to provide a body dryer which can distribute air at various angles relative to a user.

It is yet another object of the present invention to provide a body dryer that may be interchangeably used to dry an adult, a child or a pet. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
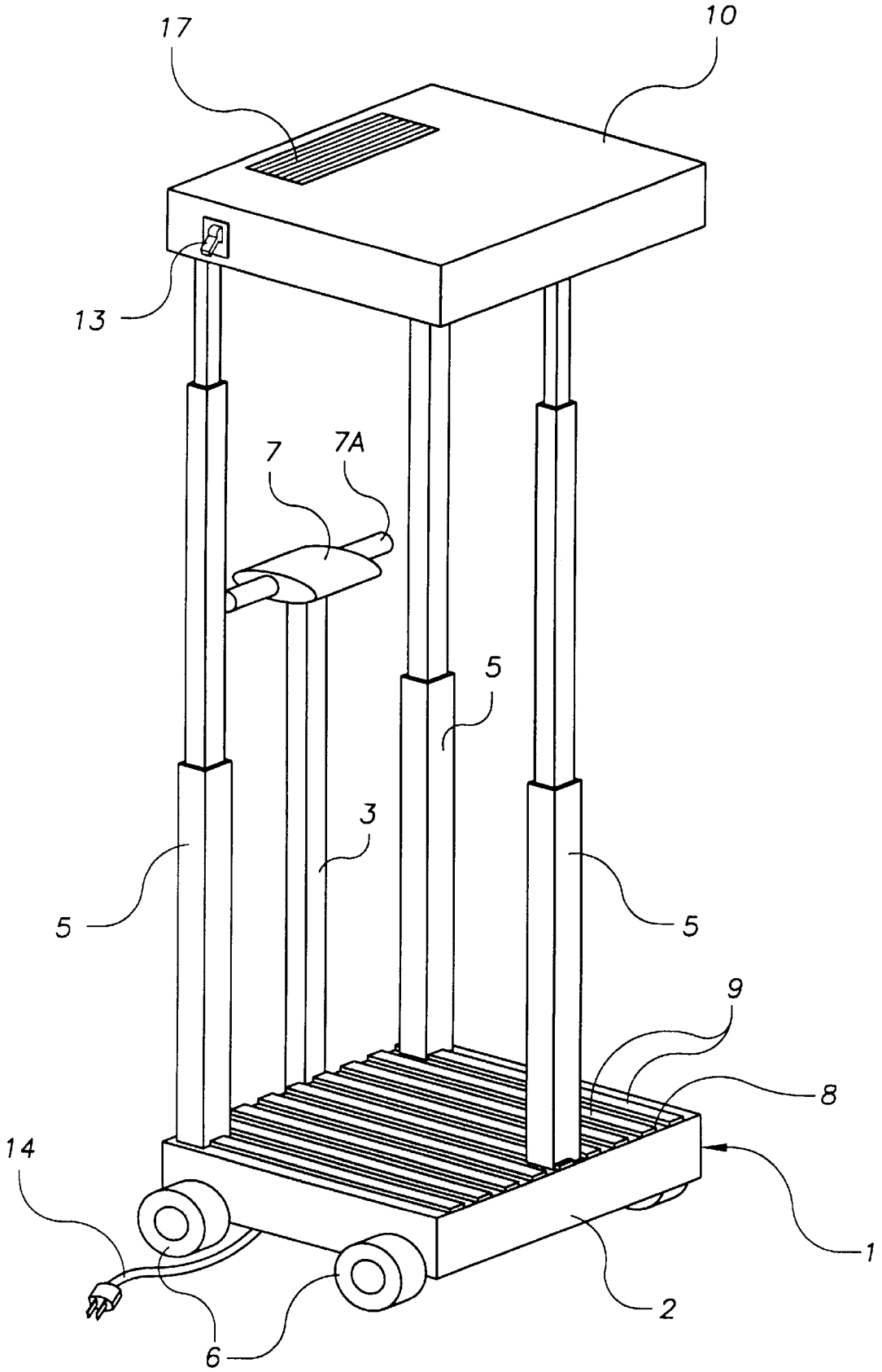
FIG. 1 is a perspective view of the inventive device.
Figure 2:
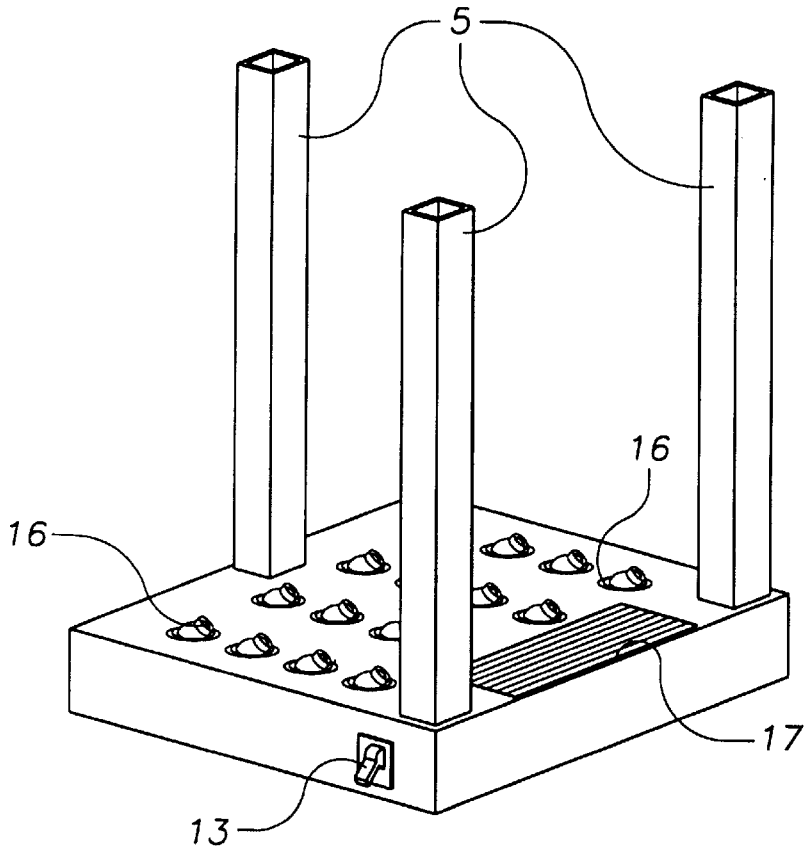
FIG. 2 is a view of the lower surface of the top component.
Figure 4:
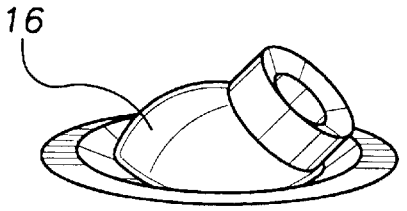
FIG. 4 is a close up view of the omni-directional air vents.
Figure 5:
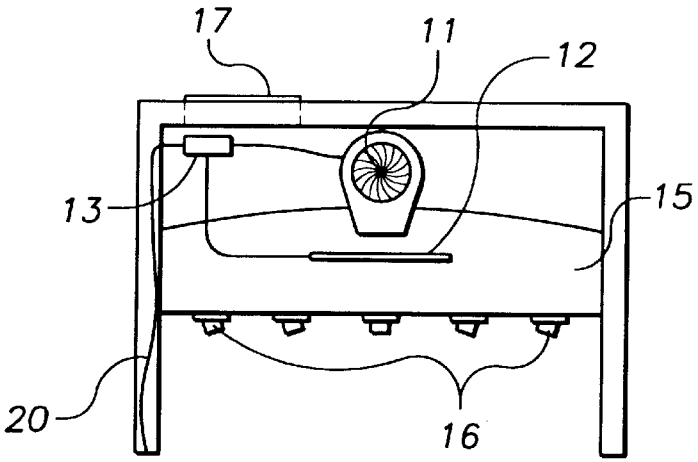
FIG. 5 is a cross sectional view of the top component with the hot air blower assembly depicted therein.
Figure 3:
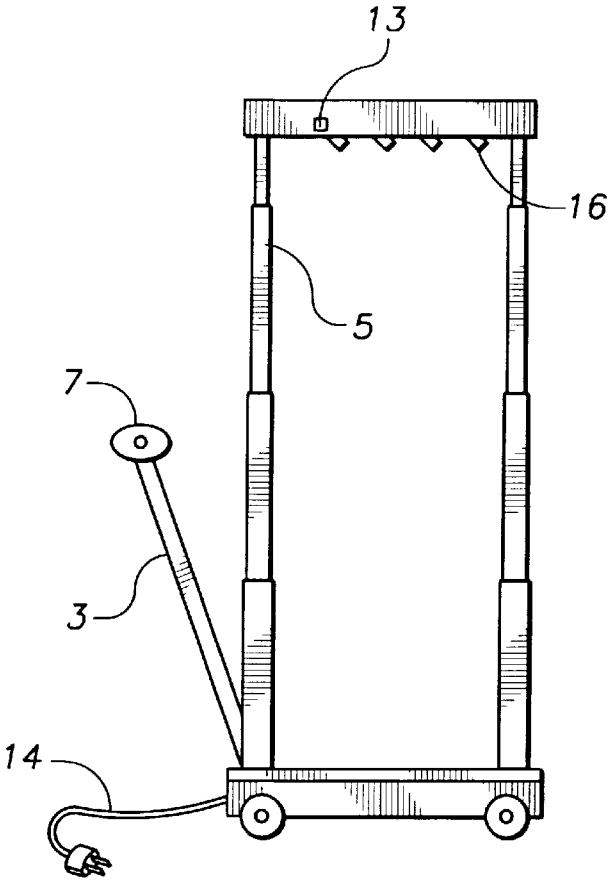
FIG. 3 is a side view of the inventive device.

Referring now to FIGS. 1 through 5, the present invention relates to a collapsible and portable body dryer comprising a substantially rectangular base component 1 having a planar upper surface with four peripheral sides 2 depending therefrom. On each of two opposing sides of the base component 1 are a pair of locking casters 6 allowing the base component to roll freely along a support surface or to be anchored thereto. Pivotally attached to a third side of the base component is an elongated arm 3 having a handle 7 attached to a distal end allowing a user to easily pull the device when transporting it from one location to another. The handle preferably includes a central portion with a pair of opposing tubular bars 7A extending therefrom.

The upper surface of the base component has a rubber mat 8 with a plurality of ridges 9 thereon for providing a frictional surface on which a user may stand. The base component has a standard 110 or a 220 volt electrical cord 14 thereon for powering a blower assembly described below.

Perpendicularly extending from the upper surface of the base component are a plurality of telescoping legs 5 each having a terminal end. Each of the legs may be locked at a select vertical height using conventional devices such as pins, hydraulics and similar means. Attached to the terminal end of each telescoping support leg 5 is a substantially rectangular hollow top component 10 having a planar lower surface, a planar upper surface and four peripheral sides, the area between which defines an interior chamber. The space between the top component and the base component defines a drying area.

Received within the top component interior chamber is a hot air blower assembly including an electric fan 11 and a heating element 12. The fan and heating element are selectively activated with a switch means 13 disposed on a side of the top component. The switch means 13 is electrically connected to the power cord 14 and the heating element and fan with wires 20. Also received within the top component interior chamber is a plenum 15 for retaining air pressure generated by the blower assembly.

On the lower surface of the top component are a plurality of omni-directional air nozzles 16 attached to the plenum and in communication with the hot air blower assembly for directing heated air downwardly toward a user. The omni-directional air nozzles are of the type generally known in the prior art and are often found on airplanes, busses and similar public vehicles. On the upper and lower surfaces of the top component is a vent 17 in communication with the interior chamber for providing ambient air to the blower assembly.

As indicated above, the present invention provides a body dryer having a drying area that is vertically adjustable allowing an adult, a child or even a pet to be interchangeably dried therein. Furthermore, the device may be easily rolled from one location, such as the bathroom, to another location such as adjacent a swimming pool.

Each of the above described components are preferably constructed with plastic or a similar lightweight material. However, as will be readily apparent to those skilled in the art, the materials of construction, size and shape of the various components may be varied without departing from the spirit of the present invention. The present invention is not to be limited to the exact details described above. For example, three telescoping legs are shown and described; however, any number of legs may be used.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A body dryer comprising:

a base component having an upper surface and four sides depending therefrom;

a plurality of telescoping support legs extending from the upper surface of said base component; each of said legs each having a terminal end; said support legs selectively movable between an extended and a retracted position;

a substantially hollow top component having an interior chamber, an upper surface and a lower surface and at least one side, said lower surface attached to the terminal ends of said telescoping legs, the space between said base component and said top component defining a drying area;

a hot air blower assembly received within said interior chamber;

a plurality of apertures on the lower surface of said top component in communication with said blower assembly for distributing hot air to the drying area.

2. A body dryer according to claim 1 wherein said hot air blower assembly comprises:

an electrical fan received within said interior chamber;

a heating element proximal said fan.

3. A body dryer according to claim 1 further comprising a plurality of lockable casters on each of two opposing sides of said base component allowing said base component to selectively roll on a support surface.

4. A body dryer according to claim 1 further comprising an elongated arm pivotally attached to a side of said base component having a handle member at a distal end thereof which may be grasped by a user when pulling the device from one location to another.

5. A body dryer according to claim 1 wherein said apertures include a plurality of omni-directional air nozzles for delivering air at select angles relative to a user standing in said drying area.

6. A body dryer according to claim 1 further comprising a vent means on the upper and lower surfaces of said top component for supplying ambient air to the blower assembly.

7. A body dryer according to claim 1 further comprising a switch means on a side of said top component in communication with said hot air blower assembly for selectively activating the assembly.

8. A body dryer according to claim 1 further comprising a rubber mat having a plurality of ridges thereon, said mat attached to the upper surface of said base component for providing a frictional surface on which a user may stand.

9. A body dryer according to claim 5 wherein said nozzles are attached to a plenum received with the interior chamber of the top component.

10. A body drier according to claim 1 further comprising a power cord in communication with said blower assembly for delivering electrical power thereto.

* * * * *